US010448186B2

(12) United States Patent
Lehtiniemi et al.

(10) Patent No.: US 10,448,186 B2
(45) Date of Patent: Oct. 15, 2019

(54) DISTRIBUTED AUDIO MIXING

(71) Applicant: Nokia Technologies Oy, Espoo (FI)

(72) Inventors: Arto Lehtiniemi, Lempäälä (FI); Antti Eronen, Tampere (FI); Jussi Leppänen, Tampere (FI); Juha Arrasvuori, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 15/835,790

(22) Filed: Dec. 8, 2017

(65) Prior Publication Data

US 2018/0167755 A1 Jun. 14, 2018

(30) Foreign Application Priority Data

Dec. 14, 2016 (EP) ..... 16204016

(51) Int. Cl.

| | |
|---|---|
| ***H04S 7/00*** | (2006.01) |
| ***H04H 60/04*** | (2008.01) |
| *G10L 19/008* | (2013.01) |
| *H04S 3/00* | (2006.01) |

(52) U.S. Cl.

CPC ..... *H04S 7/30* (2013.01); *H04H 60/04* (2013.01); *H04S 7/304* (2013.01); *H04S 7/40* (2013.01); *G10L 19/008* (2013.01); *H04S 3/008* (2013.01); *H04S 7/305* (2013.01); *H04S 2400/11* (2013.01); *H04S 2400/13* (2013.01); *H04S 2400/15* (2013.01)

(58) Field of Classification Search

CPC ..... H04S 2400/11; H04S 2400/15

See application file for complete search history.

(56) References Cited

U.S. PATENT DOCUMENTS

2005/0114121 A1* 5/2005 Tsingos ..... H04S 7/30 704/220
2007/0025555 A1* 2/2007 Gonai ..... H04R 5/04 381/17

(Continued)

FOREIGN PATENT DOCUMENTS

EP 3255904 A1 12/2017
WO 2015/150480 A1 10/2015

(Continued)

OTHER PUBLICATIONS

Smith., "Idea-Generation Techniques: A Formulary of Active Ingredients", Journal of creative behavior, vol. 32, No. 2, Jun. 1998, pp. 107-133.

(Continued)

*Primary Examiner* — Kile O Blair
(74) *Attorney, Agent, or Firm* — Harrington & Smith

(57) ABSTRACT

Systems and methods for distributed audio mixing are disclosed, comprising providing one or more predefined constellations, each constellation defining a spatial arrangement of points forming a shape or pattern and receiving positional data indicative of the spatial positions of a plurality of audio sources in a capture space. A correspondence may be identified between a subset of the audio sources and a constellation based on the relative spatial positions of audio sources in the subset. Responsive to said correspondence, at least one action may be applied, for example an audio, video and/or controlling action to audio sources of the subset.

20 Claims, 12 Drawing Sheets

(56) References Cited

U.S. PATENT DOCUMENTS

| | | | | |
|---|---|---|---|---|
| 2011/0040395 | A1* | 2/2011 | Kraemer | G10L 19/00 700/94 |
| 2012/0310396 | A1* | 12/2012 | Ojanpera | H04R 1/406 700/94 |
| 2018/0206039 | A1* | 7/2018 | Vilermo | H04S 7/30 |

FOREIGN PATENT DOCUMENTS

| | | | |
|---|---|---|---|
| WO | 2016/018787 | A1 | 2/2016 |
| WO | 2016/066743 | A1 | 5/2016 |

OTHER PUBLICATIONS

Shah et al., "Metrics for Measuring Ideation Effectiveness", Design Studies, vol. 24, No. 2, Mar. 2003, pp. 111-134.

Smith, "Towards a logic of innovation", The International Handbook on Innovation, Dec. 2003. p. 347-365.

"Readers That Sense Distance", RFID Journal, Retrieved on Dec. 19, 2017, Webpage available at : http://www.rfidjournal.com/articles/view?7393.

Hinske, "Determining the Position and Orientation of Multi-Tagged Objects Using RFID Technology", Fifth Annual IEEE International Conference on Pervasive Computing and Communications Workshops, Mar. 19-23, 2007, 5 pages.

Extended European Search Report received for corresponding European Patent Application No. 16204016.6, dated Jun. 21, 2017, 9 pages.

* cited by examiner

DISTRIBUTED AUDIO MIXING

FIELD

This specification relates generally to methods and apparatus for distributed audio mixing. The specification further relates to, but it not limited to, methods and apparatus for distributed audio capture, mixing and rendering of spatial audio signals to enable spatial reproduction of audio signals.

BACKGROUND

Spatial audio refers to playable audio data that exploits sound localisation. In a real world space, for example in a concert hall, there will be multiple audio sources, for example the different members of an orchestra or band, located at different locations on the stage. The location and movement of the sound sources is a parameter of the captured audio. In rendering the audio as spatial audio for playback such parameters are incorporated in the data using processing algorithms so that the listener is provided with an immersive and spatially oriented experience.

Spatial audio processing is an example technology for processing audio captured via a microphone array into spatial audio; that is audio with a spatial percept. The intention is to capture audio so that when it is rendered to a user the user will experience the sound field as if they are present at the location of the capture device.

An example application of spatial audio is in virtual reality (VR) and augmented reality (AR) whereby both video and audio data may be captured within a real world space. In the rendered version of the space, i.e. the virtual space, the user, through a VR headset, may view and listen to the captured video and audio which has a spatial percept.

The captured content may be manipulated in a mixing stage, which is typically a manual process involving a director or engineer operating a mixing computer or mixing desk. For example, the volume of audio signals from a subset of audio sources may be changed to improve end-user experience when consuming the content.

SUMMARY

According to one aspect, a method comprises: providing one or more predefined constellations, each constellation defining a spatial arrangement of points forming a shape or pattern; receiving positional data indicative of the spatial positions of a plurality of audio sources in a capture space; identifying a correspondence between a subset of the audio sources and a constellation based on the relative spatial positions of audio sources in the subset; and responsive to said correspondence, applying at least one action.

The at least one action may be applied to selected ones of the audio sources.

The action applied may be one or more of an audio action, a visual action and a controlling action.

An audio action may be applied to audio signals of selected audio sources, comprising one or more of: reducing or muting the audio volume, increasing the audio volume, distortion and reverberation.

A controlling action may be applied to control the spatial position(s) of selected audio source(s).

The controlling action may comprise one or more of modifying spatial position(s), fixing spatial position(s), filtering spatial position(s), applying a repelling movement to spatial position(s) and applying an attracting movement to spatial position(s).

A controlling action may be applied to control movement of one or more capture devices in the capture space.

A controlling action may be applied to apply selected audio sources to a first audio channel and other audio sources to one or more other audio channel(s).

The or each constellation may define one or more of a line, arc, circle, cross or polygon.

The positional data may be derived from positioning tags, carried by the audio sources in the capture space.

A correspondence may be identified if the relative spatial positions of the audio sources in the subset have substantially the same shape or pattern of the constellation, or deviate therefrom by no more than a predetermined distance.

The or each constellation may be defined by means of receiving, through a user interface, a user-defined spatial arrangement of points forming a shape or pattern.

The or each constellation may defined by capturing current positions of audio sources in a capture space.

According to a second aspect, there is provided a computer program comprising instructions that when executed by a computer program control it to perform the method comprising: providing one or more predefined constellations, each constellation defining a spatial arrangement of points forming a shape or pattern; receiving positional data indicative of the spatial positions of a plurality of audio sources in a capture space; identifying a correspondence between a subset of the audio sources and a constellation based on the relative spatial positions of audio sources in the subset; and responsive to said correspondence, applying at least one action.

According to a third aspect, there is provided a non-transitory computer-readable storage medium having stored thereon computer-readable code, which, when executed by at least one processor, causes the at least one processor to perform a method, comprising: providing one or more predefined constellations, each constellation defining a spatial arrangement of points forming a shape or pattern; receiving positional data indicative of the spatial positions of a plurality of audio sources in a capture space; identifying a correspondence between a subset of the audio sources and a constellation based on the relative spatial positions of audio sources in the subset; and responsive to said correspondence, applying at least one action.

According to a fourth aspect, there is provided an apparatus, the apparatus having at least one processor and at least one memory having computer-readable code stored thereon which when executed controls the at least one processor: to provide one or more predefined constellations, each constellation defining a spatial arrangement of points forming a shape or pattern; to receive positional data indicative of the spatial positions of a plurality of audio sources in a capture space; to identify a correspondence between a subset of the audio sources and a constellation based on the relative spatial positions of audio sources in the subset; and responsive to said correspondence, to apply at least one action.

According to a fifth aspect, there is provided an apparatus configured to perform the method of: providing one or more predefined constellations, each constellation defining a spatial arrangement of points forming a shape or pattern; receiving positional data indicative of the spatial positions of a plurality of audio sources in a capture space; identifying a correspondence between a subset of the audio sources and a constellation based on the relative spatial positions of audio sources in the subset; and responsive to said correspondence, applying at least one action.

BRIEF DESCRIPTION OF THE DRAWINGS

Embodiments will now be described, by way of non-limiting example, with reference to the accompanying drawings, in which.

DETAILED DESCRIPTION OF EMBODIMENTS

Embodiments herein relate generally to systems and methods relating to the capture, mixing and rendering of spatial audio data for playback.

In particular, embodiments relate to systems and methods in which there are multiple audio sources which may move over time. Each audio source generates respective audio signals and, in some embodiments, positioning information for use by the system. Embodiments provide automation of certain functions during, for example, the mixing stage, whereby one or more actions are performed automatically responsive to a subset of entities matching or corresponding to a predefined constellation which defines a spatial arrangement of points forming a shape or pattern.

An example application is in a VR system in which audio and video may be captured, mixed and rendered to provide an immersive user experience. Nokia's OZO® VR camera is used as an example of a VR capture device which comprises a microphone array to provide a spatial audio signal, but it will be appreciated that embodiments are not limited to VR applications nor the use of microphone arrays at the capture point. Local or close-up microphones or instrument pickups may be employed, for example. Embodiments may also be used in Augmented Reality (AR) applications.

Figure 1:
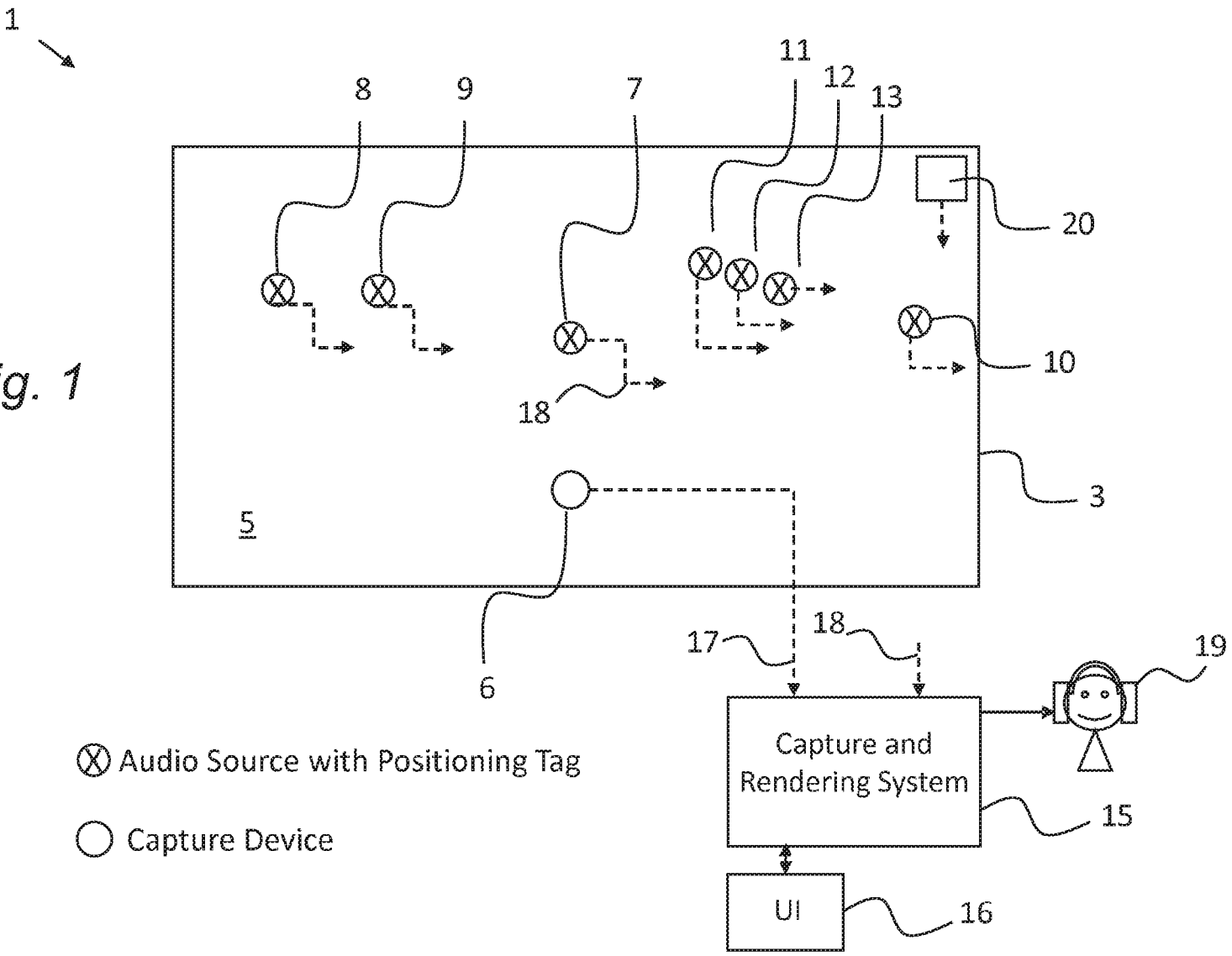
FIG. 1 is a schematic representation of a distributed audio capture scenario, including use of a mixing and rendering apparatus according to embodiments.

Referring to FIG. 1, a one example of an overview of a VR capture scenario 1 is shown together with a first embodiment capture, mixing and rendering system (CRS) 15 with associated user interface (UI) 16. The Figure shows in plan-view a real world space 3 which may be for example a sports arena. The CRS 15 is applicable to any real world space, however. A VR capture device 6 for video and spatial audio capture may be supported on a floor 5 of the space 3 in front of multiple audio sources, in this case members of a sports team; the position of the VR capture device 6 is known, e.g. through predetermined positional data or signals derived from a positioning tag on the VR capture device (not shown). The VR capture device 6 in this example may comprise a microphone array configured to provide spatial audio capture.

The sports team may be comprised of multiple members 7-13 each of which has an associated close-up microphone providing audio signals. Each may therefore be termed an audio source for convenience. In other embodiments, other types of audio source may be used. For example, if the audio sources 7-13 are members of a musical band, the audio sources may comprise a lead vocalist, a drummer, lead guitarist, bass guitarist, and/or members of a choir or backing singers. Further, for example, the audio sources 7-13 may be actors performing in a movie or television filming production. The number of audio sources and capture devices is not limited to what is presented in FIG. 1, as there may be any number of audio sources and capturing devices in a VR capture scenario.

As well as having an associated close-up microphone, the audio sources 7-13 may carry a positioning tag which may be any module capable of indicating through data its respective spatial position to the CRS 15. For example the positioning tag may be a high accuracy indoor positioning (HAIP) tag which works in association with one or more HAIP locators 20 within the space 3. HAIP systems use Bluetooth Low Energy (BLE) communication between the tags and the one or more locators 20. For example, there may be four HAIP locators mounted on, or placed relative to, the VR capture device 6. A respective HAIP locator may be to the front, left, back and right of the VR capture device 6. Each tag sends BLE signals from which the HAIP locators derive the tag, and therefore, audio source location.

In general, such direction of arrival (DoA) positioning systems are based on (i) a known location and orientation of the or each locator, and (ii) measurement of the DoA angle of the signal from the respective tag towards the locators in the locators' local co-ordinate system. Based on the location and angle information from one or more locators, the position of the tag may be calculated using geometry.

In some embodiments, other forms of positioning system may be employed, in addition, or as an alternative. For example, each audio source 7-13 may have a GPS receiver for transmitting respective positional data to the CRS 15.

The CRS 15 is a processing system having an associated user interface (UI) 16 which will explained in further detail below. As shown in FIG. 1, it receives as input from the VR capture device 6 spatial audio and video data, and positioning data, through a signal line 17. Alternatively, the positioning data may be received from the HAIP locator 20. The CRS 15 also receives as input from each of the audio sources 7-13 audio data and positioning data from the respective positioning tags, or from the HAIP locator 20, through separate signal lines 18. The CRS 15 generates spatial audio data for output to a user device 19, such as a VR headset with video and audio output.

The input audio data may be multichannel audio in loudspeaker format, e.g. stereo signals, 4.0 signals, 5.1 signals, Dolby Atmos® signals or the like. Instead of loudspeaker format audio, the input may be in the multi microphone signal format, such as the raw eight signal input from the OZO VR camera, if used for the VR capture device 6.

Figure 2:
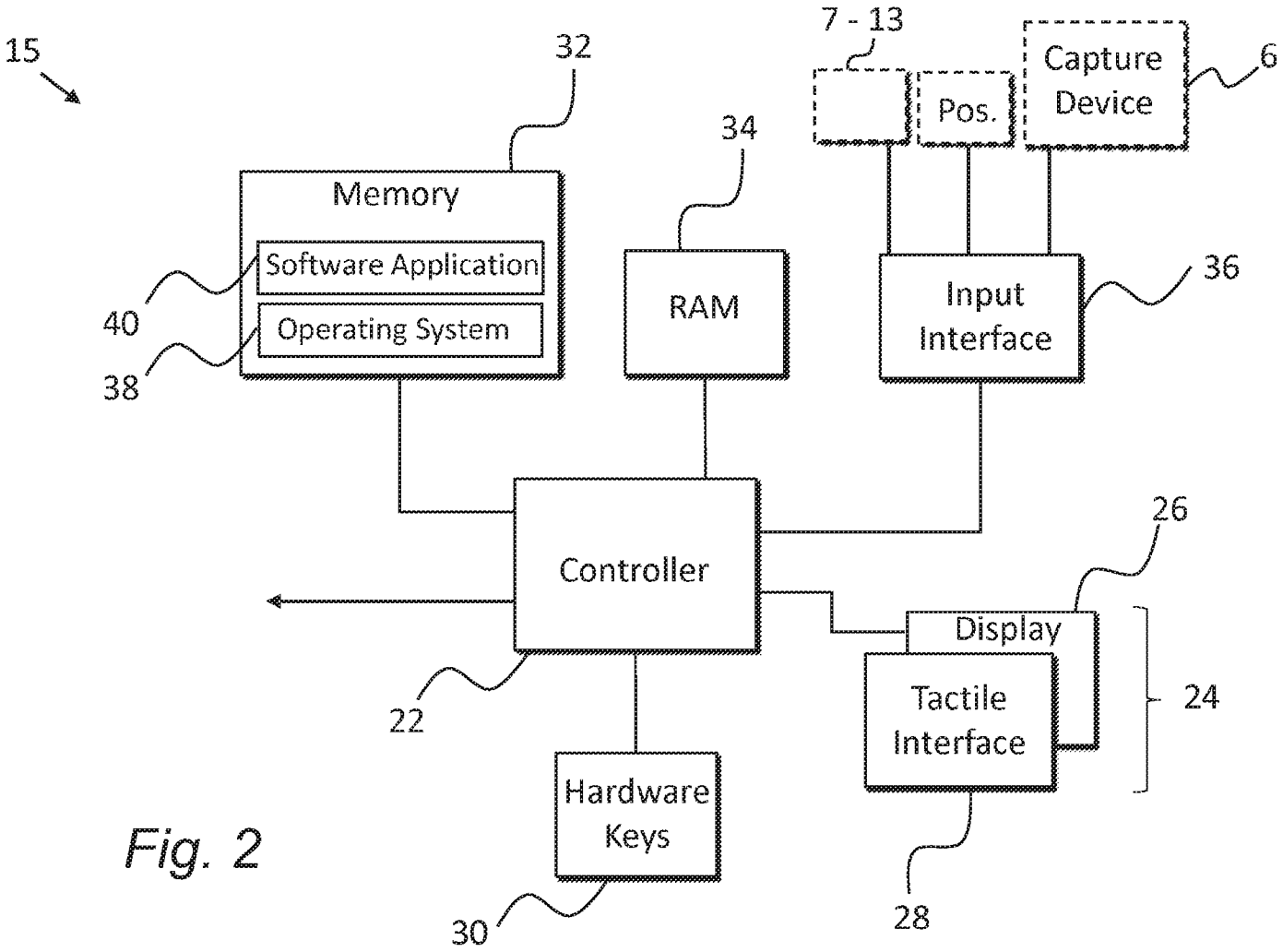
FIG. 2 is a schematic diagram illustrating components of the FIG. 1 mixing and rendering apparatus.

FIG. 2 shows an example schematic diagram of components of the CRS 15. The CRS 15 has a controller 22, a touch sensitive display 24 comprised of a display part 26 and a tactile interface part 28, hardware keys 30, a memory 32, RAM 34 and an input interface 36. The controller 22 is connected to each of the other components in order to control operation thereof. The touch sensitive display 24 is optional, and as an alternative a conventional display may be used with the hardware keys 30 and/or a mouse peripheral used to control the CRS 15 by conventional means.

The memory 32 may be a non-volatile memory such as read only memory (ROM) a hard disk drive (HDD) or a solid state drive (SSD). The memory 32 stores, amongst other things, an operating system 38 and one or more software applications 40. The RAM 34 is used by the controller 22 for the temporary storage of data. The operating system 38 may contain code which, when executed by the controller 22 in conjunction with RAM 34, controls operation of each of hardware components of the terminal.

The controller 22 may take any suitable form. For instance, it may be a microcontroller, plural microcontrollers, a processor, or plural processors.

In embodiments herein, the software application 40 is configured to provide video and distributed spatial audio capture, mixing and rendering to generate a VR environment, or virtual space, including the spatial audio.

Figure 3:
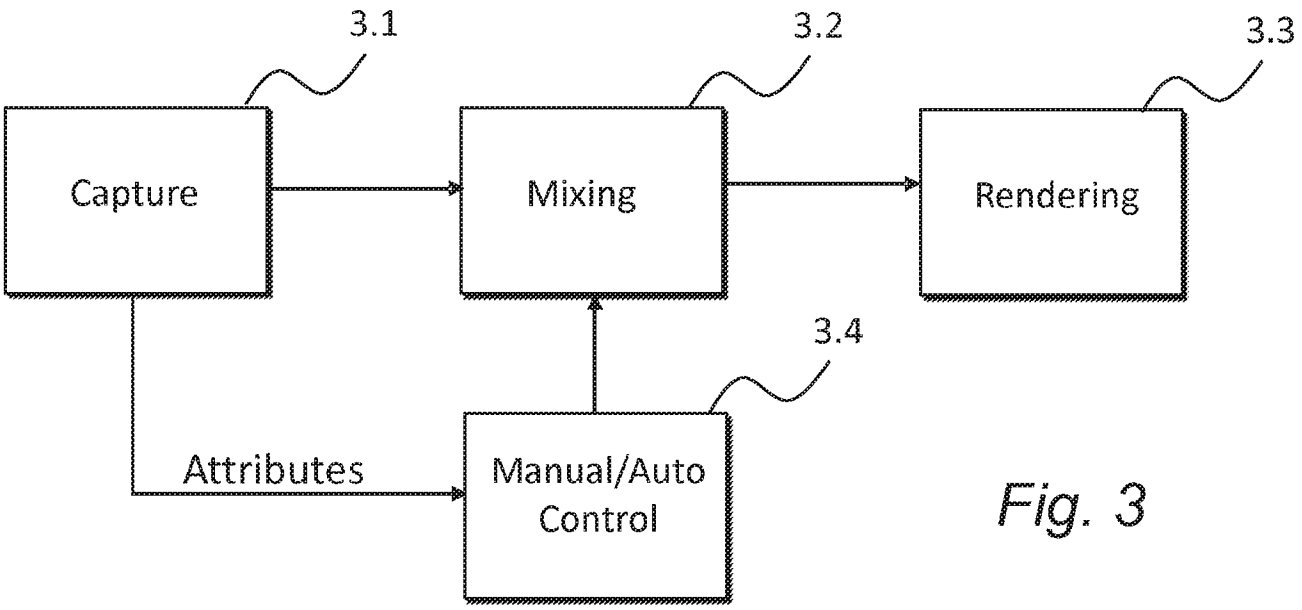
FIG. 3 is a flow diagram showing method steps of audio capture, mixing and rendering according to embodiments.

FIG. 3 shows an overview flow diagram of the capture, mixing and rendering stages of software application 40. As mentioned, the mixing and rendering stages may be combined. First, video and audio capture is performed in step 3.1; next mixing is performed in step 3.2, followed by rendering in step 3.3. Mixing (step 3.2) may be dependent on a manual or automatic control step 3.4 which may be based on attributes of the captured video and/or audio and/or positions of the audio sources. Other attributes may be used.

The software application 40 may provide the UI 16 shown in FIG. 1, through its output to the display 24, and may receive user input through the tactile interface 28 or other input peripherals such as the hardware keys 30 or a mouse (not shown). The mixing step 3.2 may be performed manually through the UI 16 or all or part of said mixing step may be performed automatically as will be explained below. The software application 40 may render the virtual space, including the spatial audio, using known signal processing techniques and algorithms based on the mixing stage.

The input interface 36 receives video and audio data from the VR capture device 6, such as Nokia's OZO® device, and audio data from each of the audio sources 7-13. The capture device may be a 360 degree camera capable of recording approximately the entire sphere. The input interface 36 also receives the positional data from (or derived from) the positioning tags on each of the VR capture device 6 and the audio sources 7-13, from which may be made an accurate determination of their respective positions in the real world space 3 and also their relative positions to other audio sources.

The software application 40 may be configured to operate in any of real-time, near real-time or even offline using pre-stored captured data.

During capture it is sometimes the case that audio sources move. For example, in the FIG. 1 situation, any one of the audio sources 7-13 may move over time, as therefore will their respective audio positions with respect to the capture device 6 and also to each other. When audio sources move, the rendered result may be overwhelming and distracting. In some cases, depending on the context of the captured scene, it may be desirable to treat some audio sources differently from others to provide a more realistic or helpful user experience. In some cases, it may be appropriate to automatically control some aspect of the mixing process based on the relative positions of audio sources, for example to reduce the workload of the mixing engineer or director.

In one example aspect of the mixing step 3.2, the software application 40 is configured to identify when at least a subset of the audio sources 7-13 matches a predefined constellation, as will be explained below.

A constellation is a spatial arrangement of points forming a shape or pattern which can be represented in data form.

The points may for example represent related entities, such as audio sources, or points in a path or shape. A constellation may therefore be an elongate line (i.e. not a discrete point), a jagged line, a cross, an arc, a two-dimensional shape or indeed any spatial arrangement of points that represents a shape or pattern. For ease of reference, a line, arc, cross etc. is considered a shape in this context. In some embodiments, a constellation may represent a 3D shape.

A constellation may be defined in any suitable way, e.g. as one or more vectors and/or a set of co-ordinates. Constellations may be drawn or defined using predefined templates, e.g. as shapes which are dragged and dropped from a menu. Constellations may be defined by placing markers on an editing interface, all of which may be manually input through the UI 16. A constellation may be of any geometrical shape or size, other than a discrete point. In some embodiments, the size may be immaterial, i.e. only the shape is important.

In some embodiments, a constellation may be defined by capturing the positions of one or more audio sources 7-13 at a particular point in time in a capture space. For example, referring to FIG. 1, it may be determined that a new constellation may be defined which corresponds to the relative positions of, or the shape defined by, the audio sources 7-9. A snapshot may be taken to obtain the constellation which is then stored for later use.

Figure 4A:
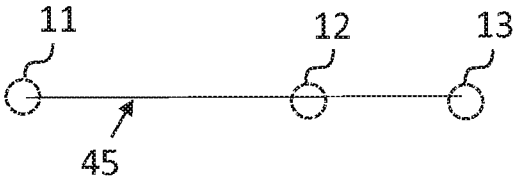
FIG. 4A, FIG. 4B, and FIG. 4C are graphical representations of respective constellations which are used in a mixing process according to embodiments.
Figure 4C:
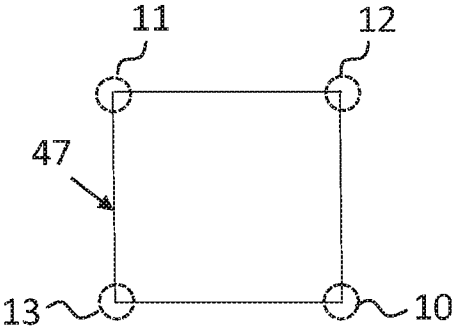
Figure 4B:
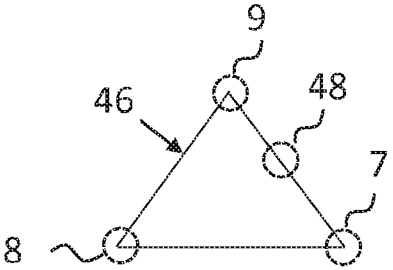

FIG. 4A, FIG. 4B, and FIG. 4C show three example constellations 45, 46, 47 which have been drawn or otherwise defined by data in any suitable manner FIG. 4A is a one-dimensional line constellation 45. FIG. 4B is an equilateral triangle constellation 46. FIG. 4C is a square constellation 47. Other examples include arcs, circles and multi-sided polygons.

The data representing each constellation 45, 46, 47 is stored in the memory 32 of the CRS 15, or may be stored externally or remotely and made available to the CRS by a data port or a wired or wireless network link. For example, the constellation data may be stored in a cloud-based repository for on-demand access by the CRS 15.

In some embodiments, only one constellation is provided. In other embodiments, a larger number of constellations are provided.

In overview, the software application 40 is configured to compare the relative spatial positions of the audio sources 7-13 with one or more of the constellations 45, 46, 47, and to perform some action in the event that a subset matches a constellation.

From a practical viewpoint, the audio sources 7-13 may be divided into subsets comprising at least two audio sources. In this way, the relative positions of the audio sources in a given subset may be determined and the corresponding shape or pattern they form may be compared with that of the constellations 45, 46, 47.

Figure 5:
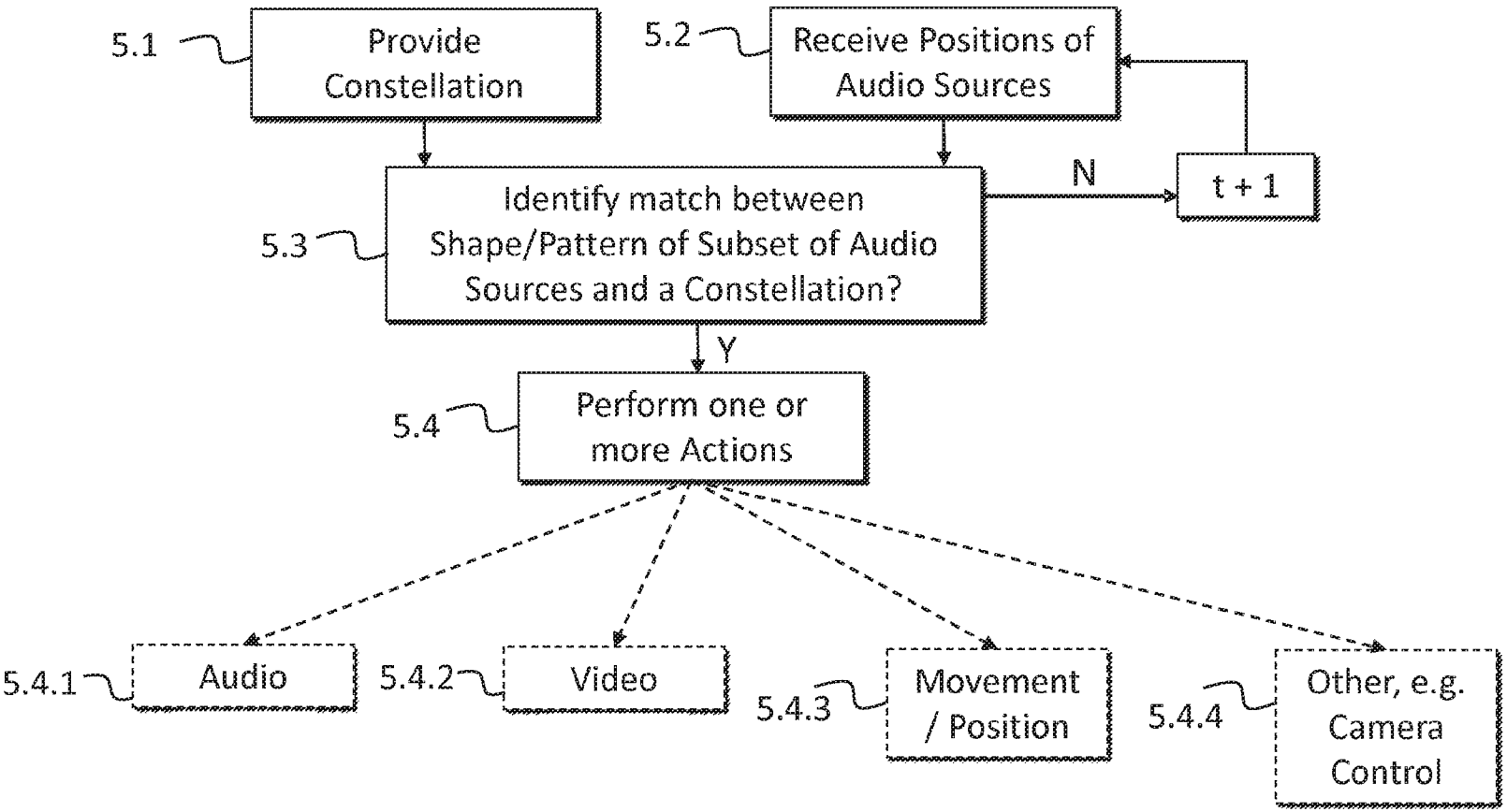
FIG. 5 is a flow diagram showing method steps of a mixing process according to embodiments.

Referring to FIG. 5, the method may comprise the following steps which are explained in relation to one subset of audio sources and one constellation. The process may be modified to compare multiple subsets in turn, or in parallel, and also with multiple constellations.

A first step 5.1 comprises providing data representing one or more constellations. A second step 5.2 comprises receiving a current set of positions of audio sources within a subset. The first step 5.1 may comprise the CRS 15 receiving the constellation data from a connected or external data source, or accessing the constellation data from local memory 32. A third step 5.3 comprises determining if a correspondence or match occurs between the shape or pattern represented by the relative positions of the subset, and one of said constellations. Example methods for determining a correspondence will be described later on. If there is a correspondence, in step 5.4 one or more actions is or are performed. If there is no correspondence, the method returns to step 5.2, e.g. for a subsequent time frame.

The method may be performed during capture or as part of a post-processing operation.

The actions performed in step 5.4 may be audio, visual positional or other control effects or a combination of said effects. Steps 5.4.1-5.4.4 represent example actions that may comprise step 5.4. A first example action 5.4.1 is that of modifying audio signals. A second example action 5.4.2 is that of modifying video or visual data. A third example action 5.4.3 is that of controlling the movement or position of certain audio sources 7-13. A fourth example action 5.4.4 is that of controlling something else, e.g. the capture device 6, which may involve moving the capture device or assigning audio signals from selected sources to one channel and other audio signals to another channel. Any of said actions 5.4.1-5.4.4 may be combined so that multiple actions may be performed responsive to a match in step 5.3.

Examples of audio effects in 5.4.1 include one or more of, but not limited to: enabling or disabling certain microphones; decreasing or muting the volume of certain audio signals; increasing the volume of certain audio signals; applying a distortion effect to certain audio signals; applying a reverberation effect to certain audio signals; and harmonising audio signals from certain multiple sources.

Examples of video effects in 5.4.2 may include changing the appearance of one or more captured audio sources in the corresponding video data. The effects may be visual effects, for example, controlling lighting; controlling at least one video projector output; controlling at least one display output.

Examples of movement/positioning effects in 5.4.3 may include fixing the position of one or more audio sources and/or adjusting or filtering their movement in a way that differs from their captured movement. For example, certain audio sources may be attracted to, or repelled away from a reference position. For example, audio sources outside of the matched constellation may be attracted to, or repelled away from, audio sources within said constellation.

Examples of camera control effects in 5.4.4 may include moving the capture device 6 to a predetermined location when a constellation match is detected in step 5.3. Such effects may be applied to more than one capture device if multiple such devices are present.

In some embodiments, action(s) may be performed for a defined subset of the audio sources, for example only those that match the constellation, or, alternatively, those that do not.

As will be explained below, rules may be associated with each constellation.

For example, rules may determine which audio sources 7-13 may form the constellation. The term 'forming' in this context refers to audio sources which are taken into account in step 5.3.

Additionally, or alternatively, rules may determine a minimum (or maximum or exact) number of audio sources 7-13 that are required to form the constellation.

Additionally, or alternatively, rules may determine how close to the ideal constellation pattern or shape the audio sources 7-13 need to be, e.g. in terms of a maximum deviation from the ideal.

Other rules may determine what action is triggered when a constellation is matched in step 5.3.

Applying the FIG. 5 method to the mixing step 3.2 enables a reduction in the workload of a human operator, e.g. a mixing engineer or director, because it may perform or triggers certain actions automatically based on spatial positions of the audio sources 7-13 and their movement.

In some embodiments, a correspondence is identified in step 5.3 if the pattern or shape formed by a subset of audio sources 7-13 overlies or has substantially the same shape as a constellation.

For example, in FIG. 4A it is seen that a correspondence will occur with the line constellation 45 when any three audio sources, in this case the audio sources 11-13, are generally aligned. The relative spacing between said audio sources 11-13 may or may not be taken into account, and nor may be their absolute position in the capture space 3. In FIG. 3*b*, it is seen that a match may occur with the triangle constellation 46 when at least three audio sources, in this case audio sources 7-9, form an equilateral triangle. Note that other audio sources 48 may or may not form part of the overall triangle shape. In FIG. 3*c*, it is seen that a match may occur with the square constellation 47 when at least four audio sources, in this case audio sources 10-13, form a square. Again, other audio sources may or more not form part of the overall square shape.

In some embodiments, markers (not shown) may be defined as part of the constellation which indicate a particular configuration of where the individual audio sources need to be positioned in order for a match to occur.

In some embodiments, a tolerance or deviation measure may be defined to allow a limited amount of error between the respective positions of audio sources when compared with a predetermined constellation. One method is to perform a fit of the audio source positions to a constellation, for example using a least squares fit method. The resulting error, for example the Mean Squared Error, for the subset of audio sources may be compared with a threshold to determine if there is a match or not.

Figure 6:
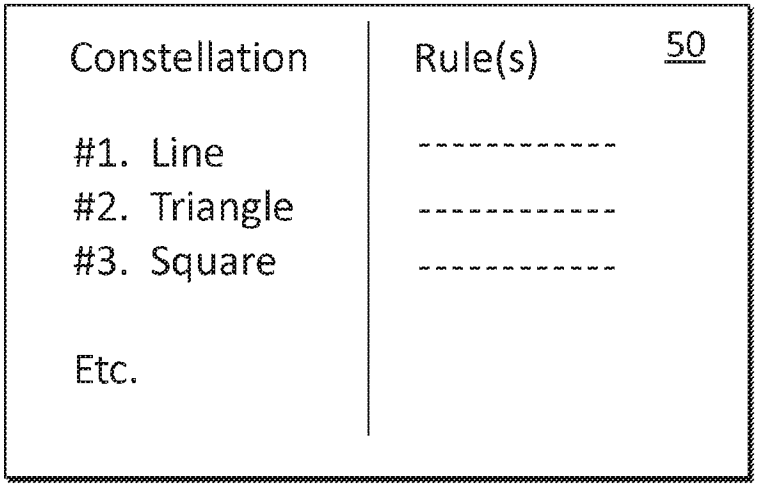
FIG. 6 is a graphical representation of a rule table for respective constellations, used in the mixing process according to embodiments.

Referring to FIG. 6, each constellation 45, 46, 47 may have one or more associated rules 50. The rules 50 may be inputted or imported by a human user using the UI 16. The rules 50 may be selected or created from a menu of predetermined rules. The rules 50 may be selected from, for example, a pull-down menu or using radio buttons. Boolean functions may be used to combine multiple conditions to create the rules 50.

Matching Rules

In some embodiments, the rules may define one or more matching criteria, i.e. criteria as to what constitutes a correspondence with said constellation for the purpose of performing step 5.3 of the FIG. 5 method. These may be termed matching rules. The matching rules may be applied for all possible combinations of the audio sources 7-13, but we will assume that the audio sources are arranged into subsets comprising two or more audio sources and the matching rules are applied to each subset.

Figure 7:
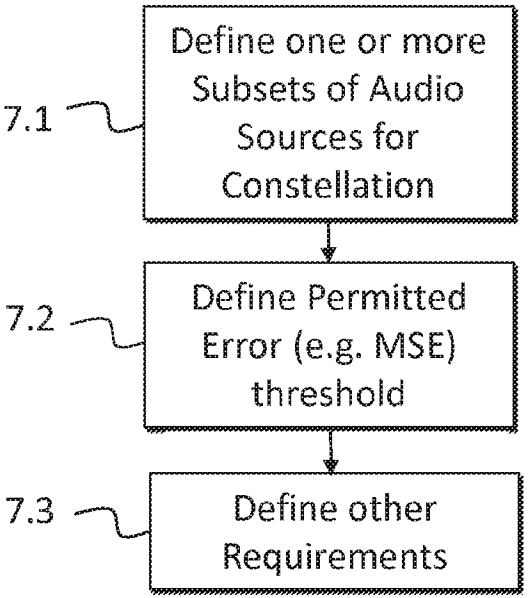
FIG. 7 is a flow diagram showing method steps for creating a matching rule table.

FIG. 7 shows an example process for creating matching rules for a given constellation, e.g. the line constellation 45. In a first step 7.1, one or more subsets of the available audio sources (which are identified by their respective positioning tags) are defined. Each subset will comprise at least two audio sources. There may be overlap between different subsets, e.g. referring to the FIG. 1 case, a first subset may comprise audio sources 7, 8, 9 and a second subset may comprise audio sources 7, 11, 12, 13. In a second step 7.2, a deviation measure may be defined, e.g. a permitted error threshold between the audio source positions and the given constellation, above which no correspondence will be determined. A third step 7.3 permits other requirements to be defined, for example a minimum length or dimensional constraint, the minimum number of audio sources needed, or particular ones of the audio sources needed to provide a correspondence. The order of the steps 7.1-7.3 can be re-arranged.

Figure 8:
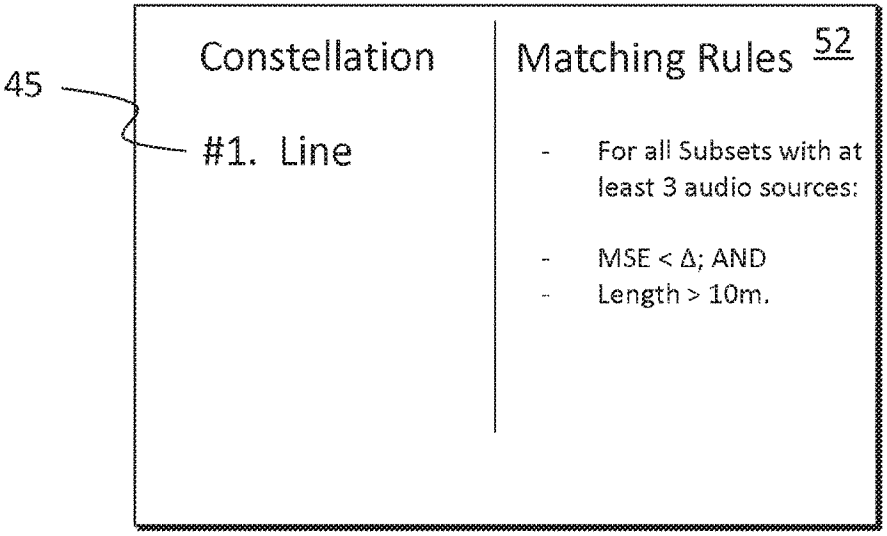
FIG. 8 is a graphical representation of a matching rule table for a constellation.

FIG. 8 is an example set of matching rules 52 created using the FIG. 7 method. Taking the line constellation 45 as an example, all subsets of audio sources with at least three audio sources are compared, and a match results only if:

(i) using a least squares error approach, the Mean Squared Error (MSE) is less than the threshold value Δ; and (ii) the length between the first and last audio sources is greater than 10 meters.

Figure 9B:
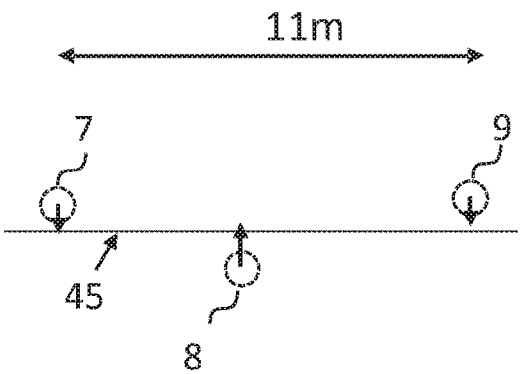
FIG. 9A, FIG. 9B are schematic representations showing a first and second arrangement of audio sources for comparison with the FIG. 8 matching rule table.
Figure 9A:
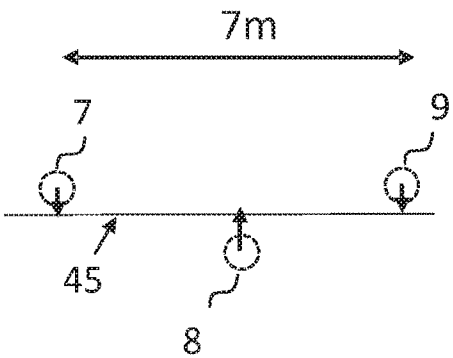

FIG. 9A and FIG. 9B are graphical representations of two situations involving a particular subset comprised of audio sources 7, 8, 9. In the case of FIG. 9A, the subset has the three tags, and the MSE is calculated to be below the value Δ. However, the length between the end audio sources 7, 9 is less than ten meters and hence there is no correspondence in step 5.3. In the case of FIG. 9B, all tests are satisfied given that the length is eleven meters and hence a correspondence with the line constellation 45 is determined in step 5.3.

Figure 10:
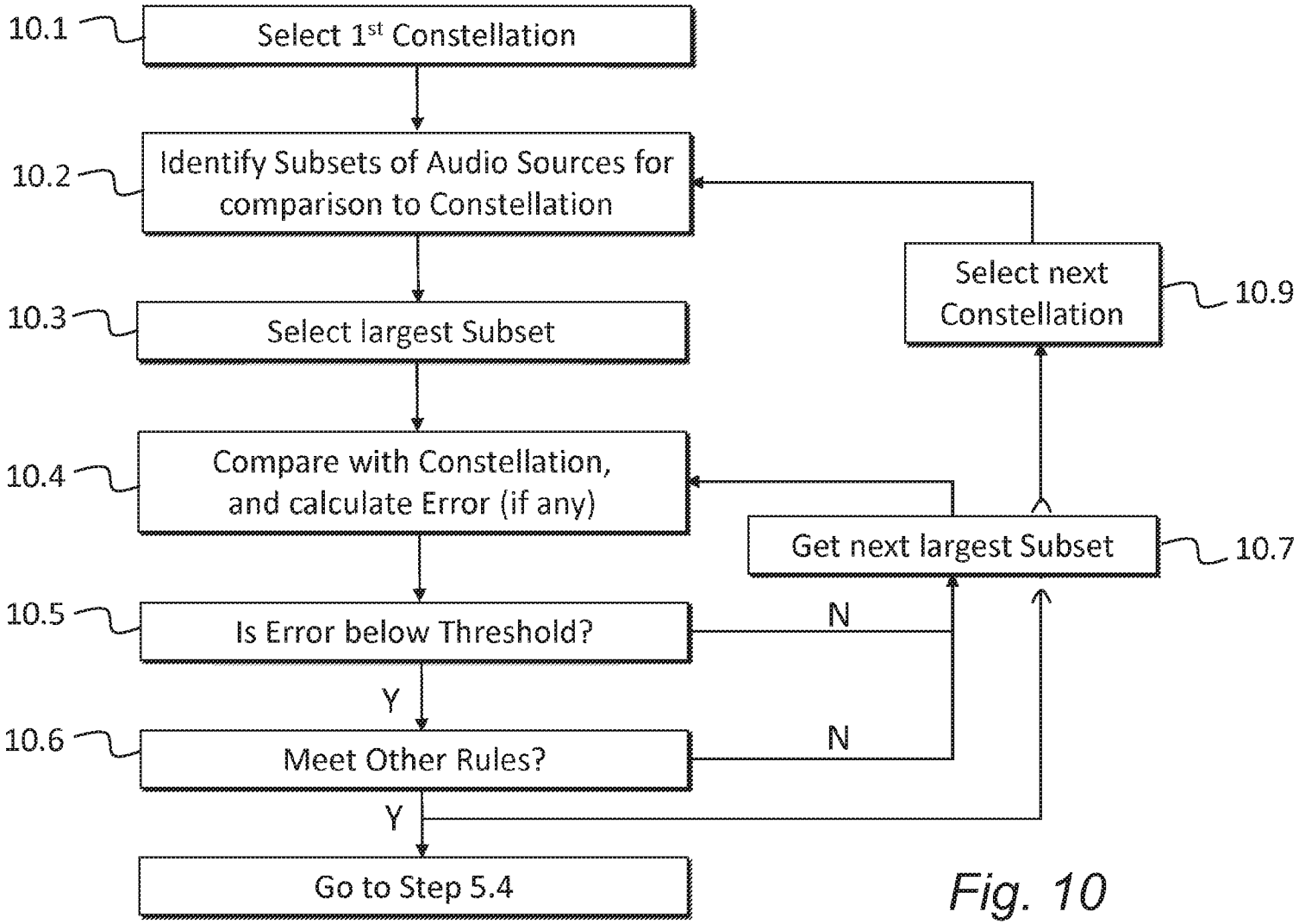
FIG. 10 is a more detailed flow diagram showing method steps of a mixing process according to embodiments.

FIG. 10 is an example of a more detailed process for applying the matching rules for multiple subsets and multiple constellations. A first step 10.1 takes the first predefined constellation. The second step 10.2 identifies the subsets of audio sources that may be compared with the constellation. The next step 10.3 selects the largest subset of audio sources, and step 10.4 compares the audio sources of this subset with the current constellation to calculate the error, e.g. the MSE mentioned above. In step 10.5 if the MSE is below the threshold, the process enters step 10.6 whereby the subset is tested against any other rules, if present, e.g. relating to the required minimum number of audio sources and/or a dimensional requirement such as length or area size. If either of steps 10.5 and 10.6 are not satisfied, the process passes to step 10.7 whereby the next largest subset is selected and the process returns to step 10.4. If step 10.6 is satisfied, or there are no further rules, then the current subset is considered a correspondence and the appropriate action(s) performed. The process passes to step 10.9 where the next constellation is selected and the process repeated until all constellations are tested.

In some embodiments, the matching rules may determine that a correspondence occurs just prior to the pattern or shape overlaying that of a constellation. In other words, some form of prediction is performed based on movement as the pattern or shape approaches that of a constellation.

In some embodiments, the matching rules may further define that the orientation of a subset of audio sources in relation to a capture device position, e.g. the position of a camera, is a factor for triggering an action.

In some embodiments, the simultaneous and coordinated movement of a subset of audio sources may be a factor for triggering an action.

Action Rules

Alternatively, or additionally, in some embodiments, rules may define one or more actions to be applied or triggered in the event of a correspondence in step 5.3. These may be termed action rules. The action rules may be applied for one or more selected subsets of the sound sources.

Figure 11:
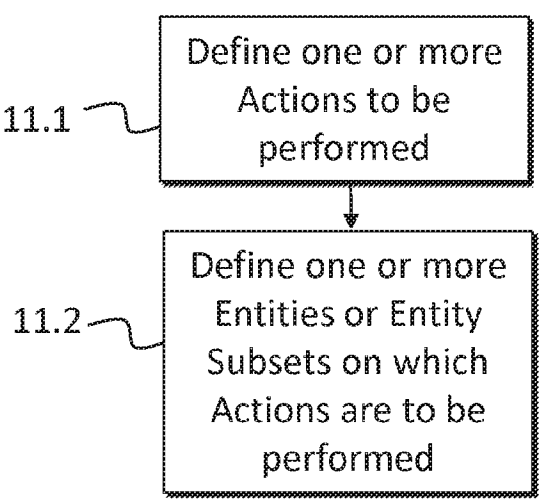
FIG. 11 is a flow diagram showing method steps for creating an action rule table.

FIG. 11 shows an example process for creating action rules for a given constellation, e.g. the line constellation 45. In a first step 11.1, one or more actions are defined, e.g. from the potential types identified in FIG. 5. In a second step 11.2, one or more entities on which the one or more actions are to be performed are defined. This may for example define "all audio sources within constellation" or "all audio sources not within constellation". In some embodiments, a particular subset of audio sources within one of these groups may be defined. Where actions do not relate to audio sources, step 11.2 may not be required.

Figure 12:
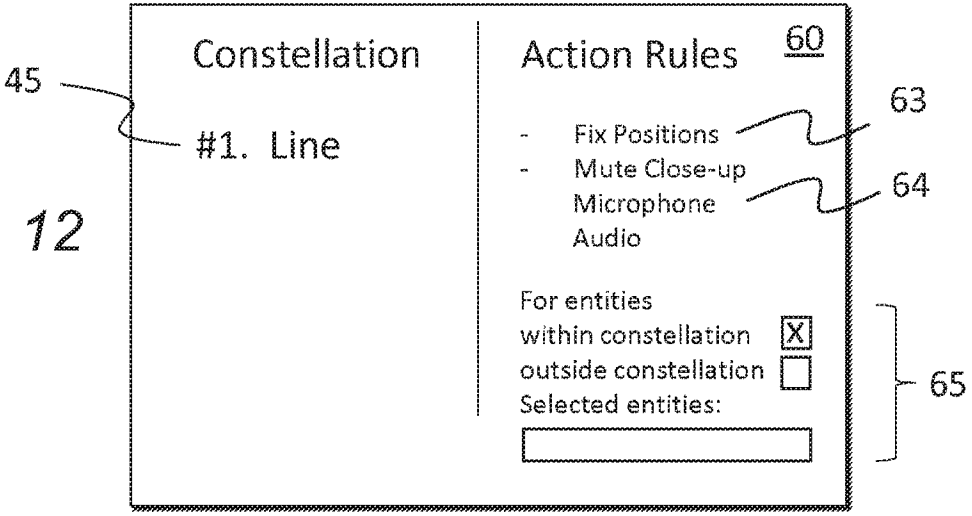
FIG. 12 is a graphical representation of an action rule table for a constellation.

FIG. 12 is an example set of action rules 60 which may be applied. Other rules may be applied to other constellations. The rules 60 are so-called action rules, in that they define actions to be performed in step 5.4 responsive to a correspondence in step 5.3. A first action rule 63 fixes the positions of certain audio sources. A second action rule 64 mutes audio signals from close-up microphones carried by certain audio sources. A selection panel 65 permits user-selection of the sound sources to which the action(s) are to be applied, e.g. sources within the constellation, sources outside of the constellation, and/or selected others which may be identified in a text box. The default mode may apply action(s) to sound sources within the constellation.

Figure 13B:
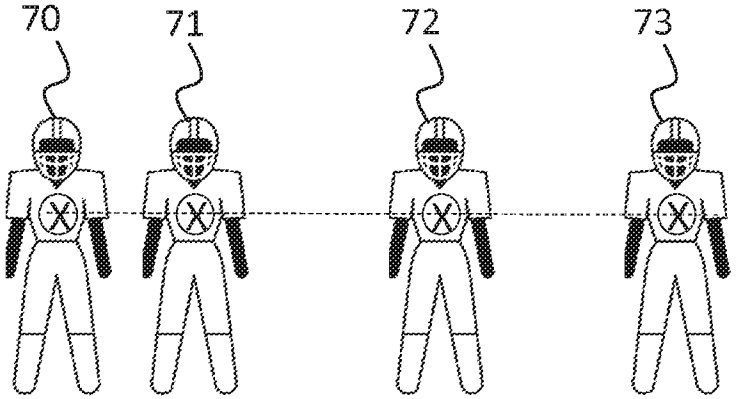
FIG. 13A and FIG. 13B are schematic representations showing a subset of audio sources in a first and subsequent time frame.
Figure 13A:
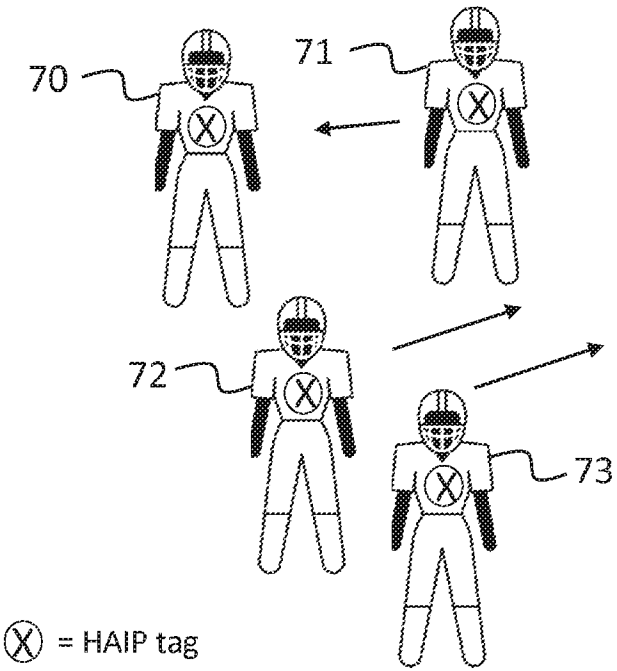

FIG. 13A and FIG. 13B respectively show a first and a subsequent capture stage. In FIG. 13A, four members 70-73 of a sports team, i.e. a subset, are shown in a first configuration, for example when the members are warming up prior to a game. Each member 70-73 carries a HAIP positioning tag so that their relative positions may be obtained and the pattern or shape they form determined. The arrows indicate movement of three members 71, 72, 73 which results in the FIG. 13B configuration whereby they are aligned and hence correspond to the line constellation 45. This configuration may occur during the playing of the national anthem, for example.

Responsive to this correspondence, the first and second action rules 63, 64 given by way of example in FIG. 12 are applied automatically by the software application 40 of the CRS 15. This fixes the spatial position of the aligned members 70-73 and mutes their respective close-up microphone signals so that their voices are not heard over the anthem.

Figure 14:
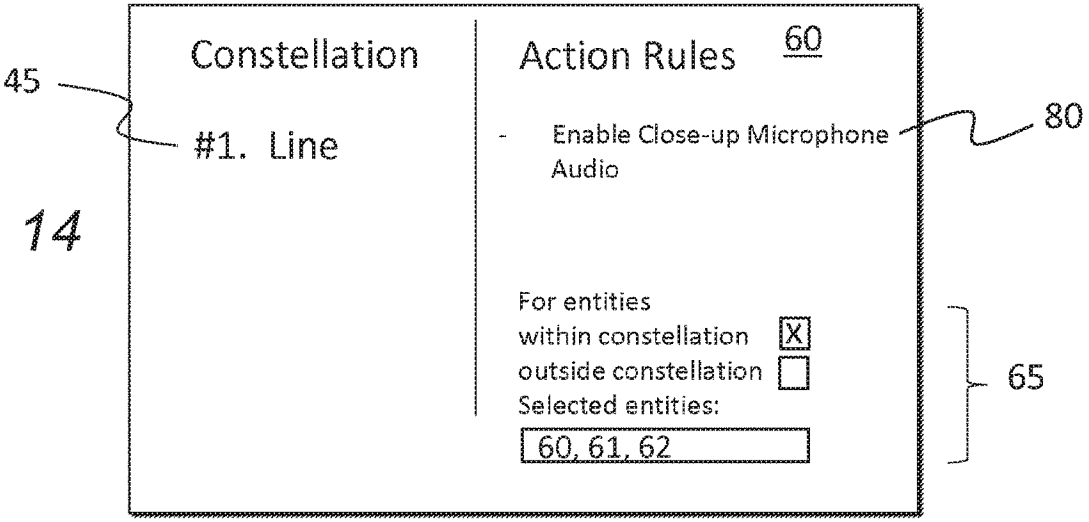
FIG. 14 is a graphical representation of a further action rule table for a constellation.

Referring to FIG. 14, the action rules 60 may comprise a different rule 80 to deal with a different situation, for example to enable the close-up microphones of only the defense-line players 60, 61, 62 when they correspond with the line constellation 45. One or more further rules may define that the enabled microphones are disabled when the line constellation breaks subsequently.

Further rules may for example implement a delay in the movement of audio sources, e.g. for a predetermined time period after the line constellation breaks.

Figure 16:
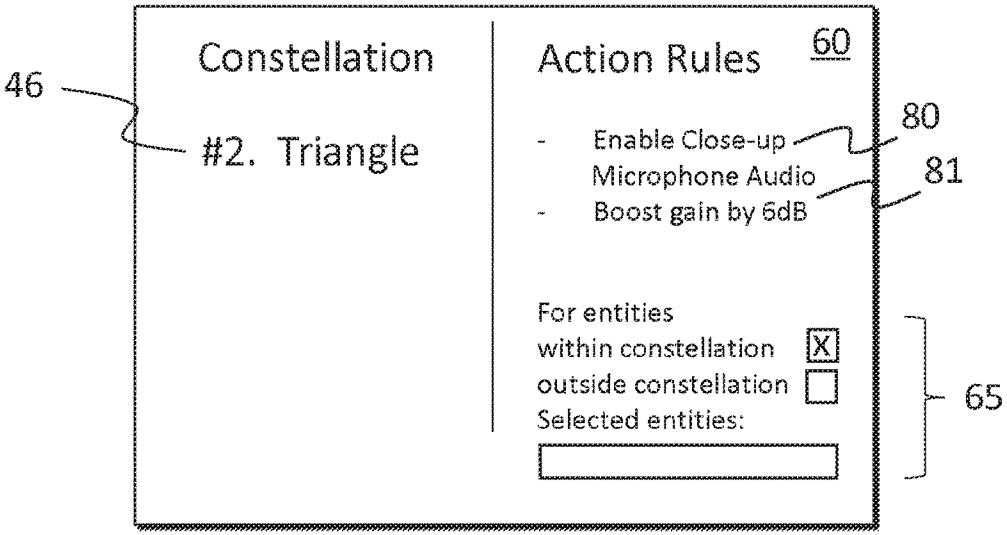
FIG. 16 is a graphical representation of an action rule table for a different constellation.
Figure 15:
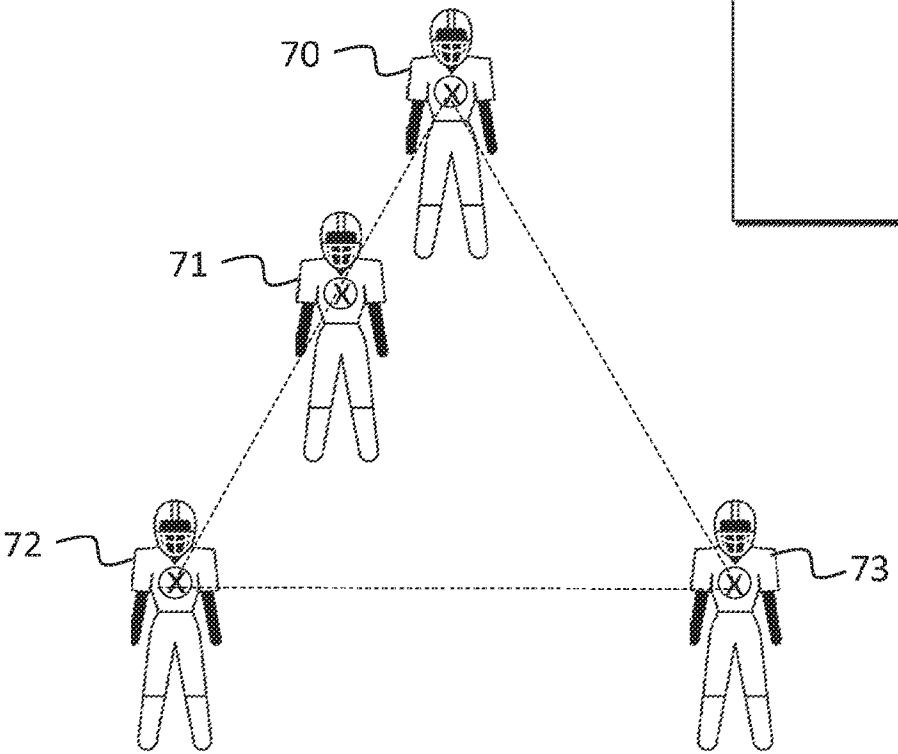
FIG. 15 is a schematic representation showing the FIG. 13 subset of audio sources in a still further time frame.

For completeness, FIGS. 15 and 16 show how subsequent movement of the audio sources 70-73 into a triangle formation may trigger a different action. FIG. 16 shows a set of action rules 60 associated with the triangle constellation 46, which causes the close-up microphones carried by the audio sources 70-73 to be enabled and boosted in response to the FIG. 15 formation being detected.

In some embodiments, the action that is triggered upon detecting a constellation correspondence may result in audio sources of the constellation being assigned to a first channel or channel group of a physical mixing table and/or to a first mixing desk. Other audio sources, or a subset of audio sources corresponding to a different constellation, may be assigned to a different channel or channel group and/or to a different mixing desk. In this way, a single controller may be used to control all audio sources corresponding to one constellation. Multi-user mixing workflow is therefore enabled.

As mentioned, the above described mixing method enables a reduction in the workload of a human operator because it performs or triggers certain actions automatically. The method may improve user experience for VR or AR consumption, for example by generating a noticeable effect if audio sources outside of the user's current field-of-view match a constellation. The method may be applied, for example, to VR or AR games for providing new features.

It will be appreciated that the above described embodiments are purely illustrative and are not limiting on the scope of the invention. Other variations and modifications will be apparent to persons skilled in the art upon reading the present application.

Moreover, the disclosure of the present application should be understood to include any novel features or any novel combination of features either explicitly or implicitly disclosed herein or any generalization thereof and during the prosecution of the present application or of any application derived therefrom, new claims may be formulated to cover any such features and/or combination of such features.

The invention claimed is:

1. A method comprising:

providing one or more predefined constellations, each constellation defining a spatial arrangement of points forming a shape or pattern;

receiving positional data indicative of spatial positions of a plurality of audio sources in a capture space;

identifying a correspondence between a subset of the audio sources and a constellation based on relative spatial positions of audio sources in the subset, where identifying the correspondence comprises at least comparing a shape or pattern formed with the spatial positions of the audio sources of the subset with the constellation; and responsive to said correspondence, applying at least one action.

2. The method of claim 1, wherein the at least one action is applied to selected ones of the audio sources.

3. The method of claim 1, wherein the action applied is one or more of:

an audio action, a visual action, or a controlling action.

4. The method of claim 3, wherein the audio action is applied to audio signals of selected audio sources, comprising one or more of:

reducing the audio volume, muting the audio volume, increasing the audio volume, distortion, or reverberation.

5. The method of claim 3, wherein the controlling action is applied to control at least one of:

the spatial position(s) of selected audio source(s); or movement of one or more capture devices in the capture space.

6. The method of claim 1, wherein each constellation defines one or more of a line, arc, circle, cross or polygon.

7. The method of claim 1, wherein the positional data is derived from positioning tags, where the audio sources carry the positioning tags in the capture space.

8. The method of claim 1, wherein the correspondence is identified if the relative spatial positions of the audio sources in the subset comprise substantially the same shape or pattern of the constellation, or deviate therefrom no more than a predetermined distance.

9. The method of claim 1, wherein definition of each constellation comprises receiving, through a user interface, a user-defined spatial arrangement of points forming a shape or pattern.

10. An apparatus having at least one processor and at least one non-transitory memory having computer-readable code stored thereon which when executed controls the apparatus to:

provide one or more predefined constellations, each constellation defining a spatial arrangement of points forming a shape or pattern;

receive positional data indicative of spatial positions of a plurality of audio sources in a capture space;

identify a correspondence between a subset of the audio sources and a constellation based on relative spatial positions of audio sources in the subset, where identification of the correspondence comprises at least comparison of a shape or pattern formed with the spatial positions of the audio sources of the subset with the constellation; and responsive to said correspondence, apply at least one action.

11. The apparatus of claim 10, wherein the at least one action is applied to selected ones of the audio sources.

12. The apparatus of claim 11, wherein definition of each constellation comprises means of receiving, through a user interface, a user-defined spatial arrangement of points forming a shape or pattern.

13. The apparatus of claim 10, wherein the action applied is one or more of:

an audio action, a visual action, or a controlling action.

14. The apparatus of claim 13, wherein the audio action is applied to audio signals of selected audio sources, comprising one or more of:

reducing the audio volume, muting the audio volume, increasing the audio volume, distortion, or reverberation.

15. The apparatus of claim 13, wherein the controlling action is applied to control the spatial position(s) of selected audio source(s).

16. The apparatus of claim 13, wherein the controlling action is applied to control movement of one or more capture devices in the capture space.

17. The apparatus of claim 13, wherein each constellation defines one or more of a line, arc, circle, cross or polygon.

18. The apparatus of claim 13, wherein the positional data is derived from positioning tags, where the audio sources carry the positioning tags in the capture space.

19. The apparatus of claim 13, wherein the correspondence is identified if the relative spatial positions of the audio sources in the subset have substantially the same shape or pattern of the constellation, or deviate therefrom no more than a predetermined distance.

20. A non-transitory computer-readable storage medium having stored thereon computer-readable code, which, when at least one processor executes the computer-readable code, causes the at least one processor to perform:

providing one or more predefined constellations, each constellation defining a spatial arrangement of points forming a shape or pattern;

receiving positional data indicative of spatial positions of a plurality of audio sources in a capture space;

identifying a correspondence between a subset of the audio sources and a constellation based on relative spatial positions of audio sources in the subset, where identifying the correspondence comprises at least comparing a shape or pattern formed with the spatial positions of the audio sources of the subset with the constellation; and responsive to said correspondence, applying at least one action.

* * * * *